US008289264B2

(12) United States Patent
So et al.

(10) Patent No.: US 8,289,264 B2
(45) Date of Patent: Oct. 16, 2012

(54) LIQUID CRYSTAL DISPLAY DEVICE AND METHOD OF DRIVING THE SAME

(75) Inventors: Hyun Jin So, Seoul (KR); Sang Yoon Park, Gyeongbuk (KR)

(73) Assignee: LG Display Co., Ltd., Seoul (KR)

( * ) Notice: Subject to any disclaimer, the term of this patent is extended or adjusted under 35 U.S.C. 154(b) by 1065 days.

(21) Appl. No.: 12/000,281

(22) Filed: Dec. 11, 2007

(65) Prior Publication Data

US 2008/0231589 A1 Sep. 25, 2008

(30) Foreign Application Priority Data

Mar. 19, 2007 (KR) ..... 10-2007-0026443

(51) Int. Cl.
*G09G 3/36* (2006.01)

(52) U.S. Cl. ..... 345/102; 345/88; 349/68

(58) Field of Classification Search ..... 345/68, 345/102

See application file for complete search history.

(56) References Cited

U.S. PATENT DOCUMENTS

| | | | | |
|---|---|---|---|---|
| 5,793,230 | A * | 8/1998 | Chu et al. | 327/77 |
| 6,127,783 | A * | 10/2000 | Pashley et al. | 315/149 |
| 6,377,270 | B1 * | 4/2002 | Eitzmann | 345/589 |
| 6,753,661 | B2 * | 6/2004 | Muthu et al. | 315/307 |
| 6,894,442 | B1 * | 5/2005 | Lim et al. | 315/291 |
| 2003/0011832 | A1 * | 1/2003 | Chang | 358/518 |
| 2005/0231457 | A1 * | 10/2005 | Yamamoto et al. | 345/102 |
| 2006/0262224 | A1 * | 11/2006 | Ha et al. | 348/582 |
| 2007/0235632 | A1 * | 10/2007 | Bin Marzuki et al. | 250/214 A |
| 2007/0285378 | A1 * | 12/2007 | Lankhorst et al. | 345/102 |

FOREIGN PATENT DOCUMENTS

| | | |
|---|---|---|
| CN | 1645206 A | 7/2005 |
| JP | 2006-171708 | 6/2006 |
| JP | 2006-276362 | 10/2206 |
| JP | 11-24588 | 1/2999 |

OTHER PUBLICATIONS

Office Action issued in corresponding Chinese Application No. 2007103083453.

* cited by examiner

*Primary Examiner* — Alexander Eisen
*Assistant Examiner* — Sanjiv D Patel
(74) *Attorney, Agent, or Firm* — Morgan, Lewis & Bockius LLP

(57) ABSTRACT

A liquid crystal display (LCD) device is provided. The LCD device includes a liquid crystal panel, a backlight unit, first, second and third light emitting diode drivers, a light-intensity detector, and an adaptive light-intensity compensator. The backlight unit includes first, second and third light emitting diode arrays respectively generating red light, green light and blue light to provide white light to the liquid crystal panel. The first, second and third light emitting diode drivers generate operating voltages driving the first, second and third light emitting diode arrays, respectively. The light-intensity detector detects an intensity of white light provided to the liquid crystal panel. The adaptive light-intensity compensator controls the first, second and third light emitting diode drivers to compensate the intensities of the red light, the green light and the blue light, respectively.

10 Claims, 4 Drawing Sheets

LIQUID CRYSTAL DISPLAY DEVICE AND METHOD OF DRIVING THE SAME

The present application claims priority under 35 U.S.C. 119 and 35 U.S.C. 365 to Korean Patent Application No. 10-2007-0026443 (filed on Mar. 19, 2007), which is hereby incorporated by reference in its entirety.

BACKGROUND OF THE INVENTION

1. Field of the Invention

The present disclosure relates to a liquid crystal display (LCD) device, and more particularly, to an LCD device for improving image quality, and a method of driving the same.

2. Discussion of the Related Art

In general, a cathode ray tube (CRT), which is one of common display devices, has been widely used as a monitor for a television (TV), a measuring device, or an information terminal device. However, the CRT is too heavy and too large to meet the demands of small and lightweight electronic products.

In fact, the weight and size of the CRT have motivated a search for its replacement. Examples of potential substitute display devices include liquid crystal displays (LCD), other devices using electro-optic effects, plasma display panels (PDP) using gas discharge, and an electro-luminescence display (ELD) device using an electro-luminescent effect. Of those display devices, research in LCD devices is the most promising.

Most of the LCD devices display an image by controlling the amount of light transmitted by an exterior source. The source is typically a backlight unit for emitting light to a liquid crystal panel. The backlight unit is categorized into an edge type and a rear type according to the position where a lamp is installed.

Examples of the light source include electro-luminescence (EL) light sources, a light emitting diodes (LED), and a code cathode fluorescent lamps (CCFL). The long lifespan, low power consumption, and thin profile of the CCFL makes it particularly useful for a large-screen LCD devices. However, the backlight unit employing the CCFL as a light source has a low color reproduction rate because of a light emission characteristic of the light source. Also, the size and capacity of the CCFL makes it difficult to implement a high-brightness backlight unit.

Backlight units have been used to allow a user to read information displayed on a screen of the LCD in dark places. Light guide plates are currently used to cope with various demands for a design, low power consumption while maintaining a thin profile. Also, the backlight unit is developed to a plurality of colors, and employs LEDs to reduce power consumption.

If the backlight device employing the LED is used continuously for a long period of time, heat generated from the LEDs increases the internal temperature, and also increases current flowing through the LEDs, which causes an intensity of light generated from the LEDs to decrease. If the LCD device including the LED backlight unit is used for a long time, optical efficiency varies over an operation time because of a characteristic of the LCD device, and the quality of light decreases. Also, if such an LCD device is driven for a long time, an internal temperature of the LCD device increases. The increase in internal temperature and operation time of the LCD device causes image quality defects such as color deterioration.

SUMMARY OF THE INVENTION

Accordingly, embodiments of the invention are directed to a liquid crystal display device and method of driving the same that substantially obviates one or more of the problems due to limitations and disadvantages of the related art.

An object of embodiments of the invention is to provide a liquid crystal display device with a backlight unit and an adaptive light-intensity compensator for compensating intensities of the light emitting diodes of the backlight.

Another object of embodiments of the invention is to provide of a method of driving a liquid crystal display device including a liquid crystal panel with a backlight unit and an adaptive light-intensity compensator by using the adaptive light-intensity compensator to compensate intensities of the light emitting diodes of the backlight.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, the liquid crystal display device and method of driving the same includes a liquid crystal display device including: a liquid crystal panel; a backlight unit including first, second and third light emitting diode arrays respectively for generating red light, green light and blue light to provide white light to the liquid crystal panel; first, second and third light emitting diode drivers for generating operating voltages driving the first, second and third light emitting diode arrays, respectively; a light-intensity detector for detecting the intensity of the white light provided to the liquid crystal panel; and an adaptive light-intensity compensator for controlling the first, second and third light emitting diode drivers and compensating intensities of the red light, the green light and the blue light, respectively.

In another aspect, the liquid crystal display device and method of driving the same includes: a method of driving a liquid crystal display device including a liquid crystal panel and first, second and third light emitting diode arrays respectively generating red light, green light and blue light to provide white light to the liquid crystal panel, the method comprising: detecting an intensity of the white light provided to the liquid crystal panel; estimating respective intensities of red light, green light and blue light by using the detected intensity of the white light; compensating intensities of the red light, the green light and the blue light on the basis of the estimated intensities of the red light, the green light and the blue light, respectively; and generating operating voltages to allow the first, second and third light emitting diode arrays to generate light with the compensated light intensity, respectively.

It is to be understood that both the foregoing general description and the following detailed description are exemplary and explanatory and are intended to provide further explanation of embodiments of the invention as claimed.

DETAILED DESCRIPTION OF THE PREFERRED EMBODIMENTS

Any reference in this specification to "one embodiment," "an embodiment," "exemplary embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art. Reference will now be made in detail to the embodiments of the present disclosure, examples of which are illustrated in the accompanying drawings.

Figure 1:
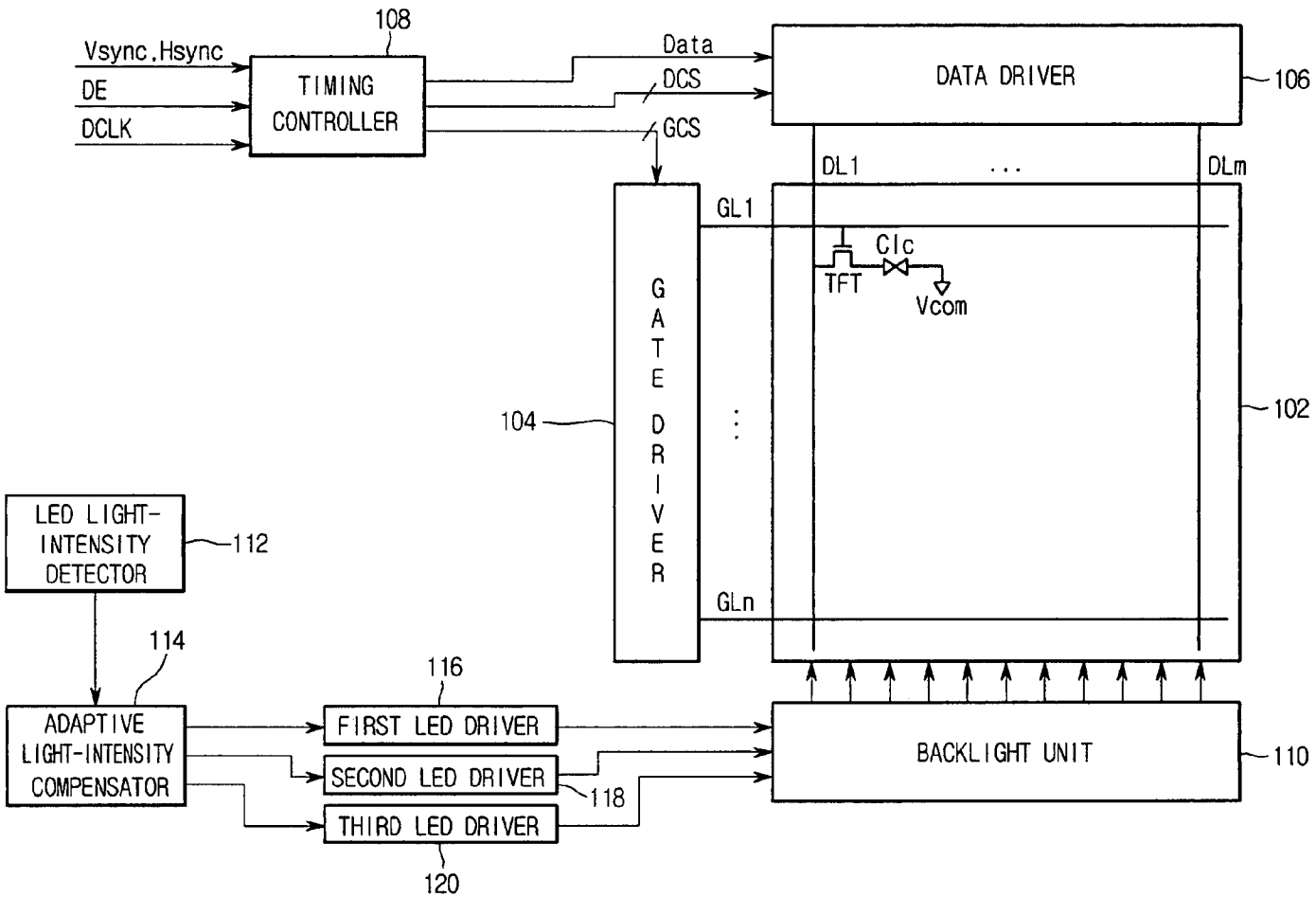
FIG. 1 is a view illustrating an LCD device according to an embodiment.

FIG. 1 is a view illustrating an LCD device according to an embodiment. As shown in FIG. 1, the LCD device according to an embodiment includes a liquid crystal panel 102, a data driver 106, a gate driver 104, a timing controller 108, and a backlight unit 110. The liquid crystal panel 102 displays an image. The data driver 106 drives a plurality of data lines DL1 to DLm on the liquid crystal panel 102. The gate driver 104 drives a plurality of gate lines GL1 to GLn on the liquid crystal panel 102. The timing controller 108 controls driving timing of the data driver 106 and the gate driver 104. The backlight unit 110 generates light and emits the light to the liquid crystal panel 102.

The LCD device according to an embodiment further includes first, second and third light emitting diode (LED) drivers 116, 118 and 120, an adaptive light-intensity compensator 114, and an LED light-intensity detector 112. The first, second and third LED drivers 116, 118 and 120 generate operation voltages to drive the backlight unit 110, respectively. The adaptive light-intensity compensator 114 compensates light intensities of the first, second and third LED drivers 116, 118 and 120. The LED light-intensity detector 112 detects an intensity of light emitted to the liquid crystal panel 102 in real time.

The liquid crystal panel 102 includes pixels formed in respective areas defined by the plurality of gate lines GL1 to GLn and the plurality of data lines DL1 to DLm. Each of the pixels includes a thin film transistor TFT formed at an intersection of the gate line GL1 to GLn and the corresponding data line DL1 to DLn, and a liquid crystal cell Clc connected between the thin film transistor TFT and a common electrode Vcom.

The thin film transistor TFT switches a pixel data voltage that is to be supplied from the data line DL to the liquid crystal cell Clc in response to a gate scan signal on the gate line GL. The liquid crystal cell Clc includes a common electrode Vcom and a pixel electrode connected to the thin film transistor TFT. The common electrode Vcom and the pixel electrode face each other with a liquid crystal layer therebetween. The liquid crystal cell Clc is charged with a pixel data voltage supplied via the thin film transistor TFT. The voltage charged in the liquid crystal cell Clc is updated whenever the thin film transistor TFT is turned on.

Also, each of the pixels on the liquid crystal panel 102 includes a storage capacitor Cst (not shown) connected between the thin film transistor TFT and each of the gate lines GL1 to GLn. The storage capacitor Cst (not shown) minimizes natural attenuation of a voltage charged in the liquid crystal cell Clc.

The gate driver 104 supplies a plurality of gate scan signals to the plurality of gate lines GL1 to GLn in response to gate control signals GCS from the timing controller 108. The plurality of gate scan signals enable the plurality of gate lines GL1 to GLn sequentially for each period of a first horizontal synchronization signal.

Whenever one of the plurality of data lines DL1 to DLm is enabled, the data driver 106 generates a plurality of pixel data voltages in response to data control signals DCS from the timing controller 108, and supplies the plurality of data voltages to the plurality of data lines DL1 to DLm on the liquid crystal panel 102, respectively. To this end, the data driver 106 receives pixel data voltages for each line from the timing controller 108, and converts the input pixel data for each line into analog pixel data voltages by using a gamma voltage set.

The timing controller 108 generates the gate control signals GCS, the data control signals DCS, and a polarity inversion signal POL (not shown) by using a data clock DLCK, a horizontal synchronization signal Hsync, a vertical synchronization signal Vsync, and a data enable signal DE from an external system such as a graphic module of a computer system (not shown) or an image demodulation module of a TV reception system (not shown). The gate control signals GCS are provided to the gate driver 104, and the data control signals DCS and the polarization inversion signal POL are provided to the data driver 106.

Figure 2:
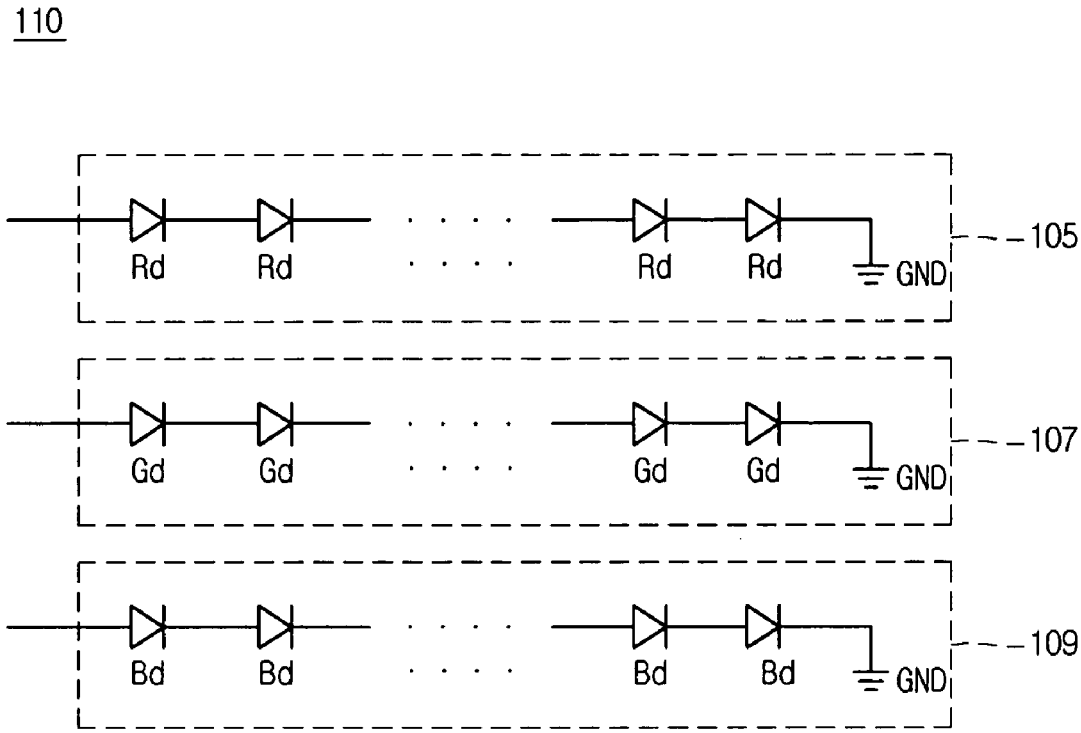
FIG. 2 is a view illustrating a backlight unit of the LCD device of FIG. 1.

FIG. 2 is a view illustrating a backlight unit of the LCD device of FIG. 1. Referring to FIG. 2, the backlight unit 110 includes first, second and third LED arrays 105, 107 and 109 that are arranged and covered by optical sheets (not shown) and units (not shown) for supporting the optical sheets on the LED arrays 105, 107 and 109. The optical sheets (not shown) allow light generated from the first, second and third LED arrays 105, 107 and 109 to have uniform brightness, and emit light with the uniform brightness to the liquid crystal panel 102.

The first LED array 105 includes a plurality of diodes Rd generating red light (R) and connected in series. The second LED array 107 includes a plurality of diodes Gd generating green light (G) and connected in series. The third LED array 109 includes a plurality of diodes Bd generating blue light (B) and connected in series. White light generated from the backlight unit 110 is emitted to the liquid crystal panel 102 to display an image on the liquid crystal panel 102.

The first LED array 105 is driven by an operating voltage supplied from the first LED driver 116 (FIG. 1). The second LED array 107 is driven by an operating voltage supplied from the second LED driver 118 (FIG. 1). The third LED array 109 is driven by an operating voltage supplied from the third LED driver 120 (FIG. 1).

The first, second and third LED drivers 116, 118 and 120 generate operating voltages respectively corresponding to the light intensity compensated at the adaptive light-intensity compensator 114 that supplies the operating voltages to the backlight unit 110. The detailed description of the adaptive light-intensity compensator 114 will be described later.

As described above, the LED light-intensity detector 112 detects an intensity of white light emitted from the backlight unit 110 to the liquid crystal panel 102 in real time, and provides the detected value to the adaptive light-intensity compensator 114. The adaptive light-intensity compensator 114 compensates the light intensity provided from the LED light-intensity detector 112, and provides the compensated light intensity to the first, second and third LED drivers 116, 118 and 120. Detailed description of the LED light-intensity detector 112 will now be described.

Figure 3:
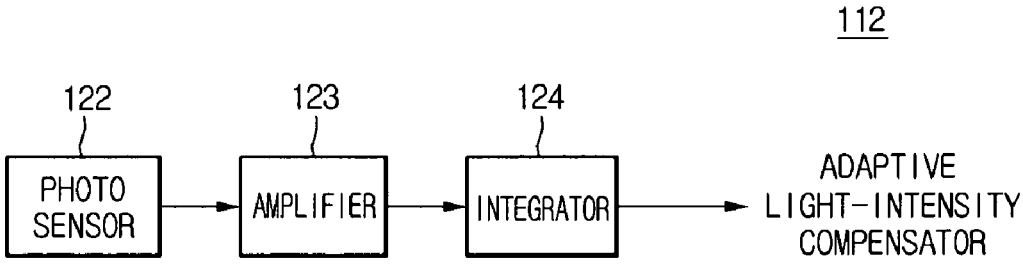
FIG. 3 is a block diagram of an LED light-intensity detector of the LCD device of FIG. 1.

FIG. 3 is a block diagram of the LED light-intensity detector of FIG. 1. Referring to FIGS. 1 and 3, the LED light-intensity detector 112 includes a photo sensor 122, and an integrator 124 corresponding to the photo sensor 122. An amplifier 123 may be placed between the photo sensor 122 and the integrator 124. The amplifier 123 amplifies a value detected from the photo sensor 122, and provides the amplified value to the integrator 124.

The photo sensor 122 detects an intensity of white light emitted to the liquid crystal panel 102 and provides an electrical signal corresponding to the detected intensity of the white light to the amplifier 123. The photo sensor 122 may be a photo diode or a photo transistor. The amplifier 123 amplifies the electrical signal provided from the photo sensor 122 and provides the amplified value to the integrator 124. The integrator 124 integrates the amplified value provided from the amplifier 123. The electrical signal amplified in the amplifier 123 and corresponding to the intensity of the white light is integrated at the integrator 124, and is converted into a voltage value V of a direct current (DC) component. The voltage value V is provided to the adaptive light-intensity compensator 114 of FIG. 1. The integrator 124 may be configured as a low-pass filter.

The voltage value V integrated at the integrator 124 is provided to the adaptive light-intensity compensator 114, and the adaptive light-intensity compensator 114 compensates light intensity by using the value V integrated at the integrator 124. The adaptive light-intensity compensator 114 will now be described in detail.

Figure 4:
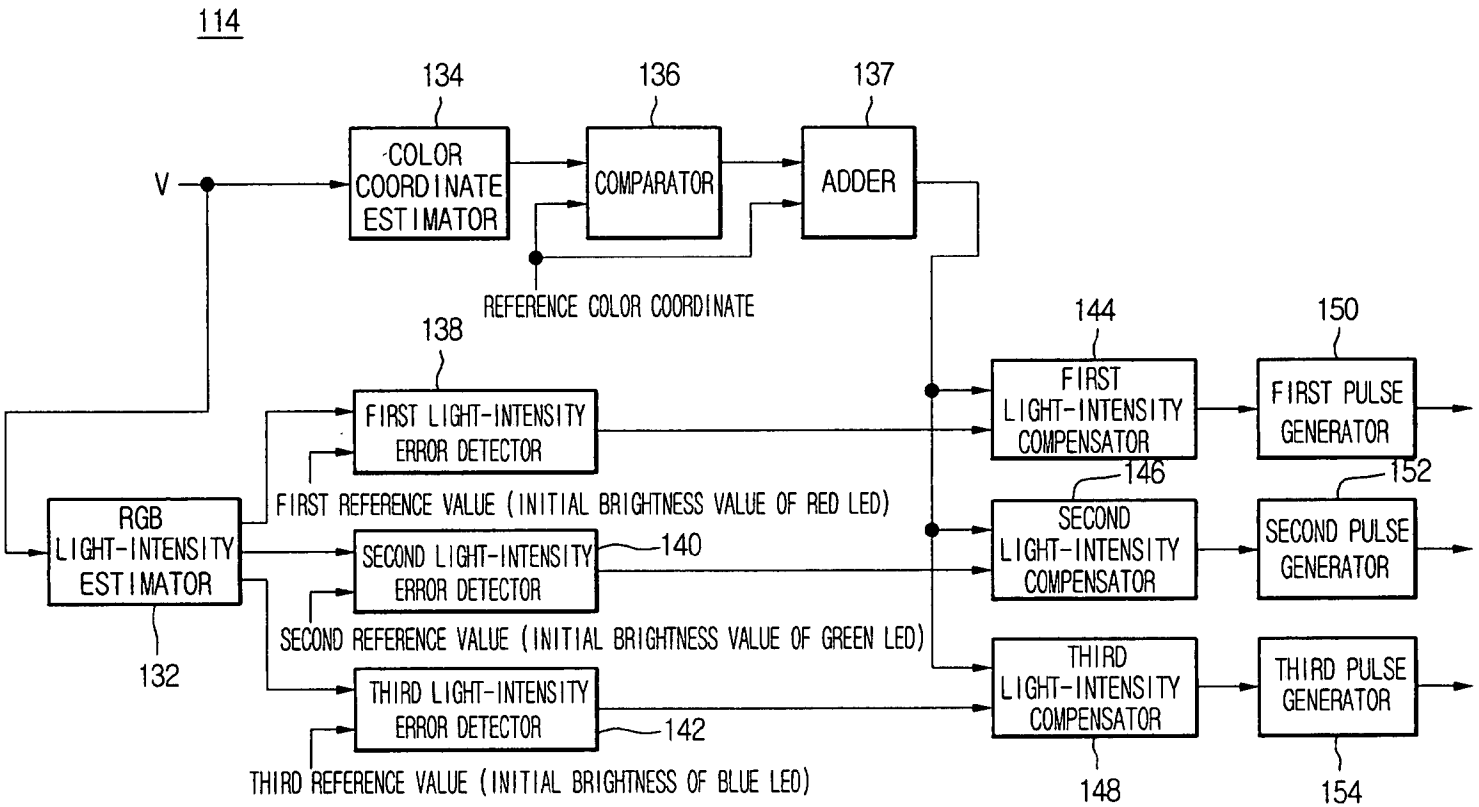
FIG. 4 is a block diagram of an adaptive light-intensity compensator of the LCD device of FIG. 1.

FIG. 4 is a block diagram of the adaptive light-intensity compensator of FIG. 1. Referring to FIG. 4, the adaptive light-intensity compensator 114 includes a color-coordinate estimator 134, a comparator 136, and an adder 137. The color-coordinate estimator 134 estimates a current color coordinate of white light emitted to the liquid crystal panel 102 by using the voltage value V output from the integrator 124 (FIG. 3) of the LED light-intensity detector 112 (FIG. 2). The comparator 136 compares the color coordinate estimated at the color-coordinate estimator 134 with a reference color coordinate, and calculates a different value between. The adder 137 adds the different value calculated at the comparator to the reference color coordinate.

The adaptive light-intensity compensator 114 further includes an RGB light-intensity estimator 132, a first light-intensity error detector 138, a second light-intensity error detector 140, and a third light-intensity error detector 142. The RGB light-intensity estimator 132 estimates the respective intensities of red light (R), green light (G) and blue light (B) by using the voltage value V output from the integrator 124 (FIG. 3). The first light-intensity error detector 138 compares the intensity of red light (R) estimated at the RGB light-intensity estimator 132 with a first reference value to calculate a different value therebetween. The second light-intensity error detector 140 compares the intensity of green light (G) estimated at the RGB light-intensity estimator 132 to calculate a different value therebetween. The third light-intensity error detector 142 compares the intensity of blue light (B) estimated at the RGB light-intensity estimator 132 to calculate a difference value therebetween.

The adaptive light-intensity compensator 114 further includes a first light-intensity compensator 144, a second light-intensity compensator 146, a third light-intensity compensator 148, and first, second and third pulse generators 150, 152 and 154. The first light-intensity compensator 144 compensates the intensity of the red light (R) by using the value calculated at the adder 137 and the different value calculated at the first light-intensity error detector 138. The second light-intensity compensator 146 compensates the intensity of the green light (G) by using the value added at the adder 137 and the different value calculated at the second light-intensity error detector 140. The third light-intensity compensator 148 compensates the intensity of the blue light (B) by using the value calculated at the adder 137 and the difference value calculated at the third light-intensity error detector 142. The first, second and third pulse generators 150, 152 and 154 generate pulses corresponding to the intensities of the red, green and blue light (R, G and B) compensated at the first, second and third light-intensity compensators 144, 146 and 148, respectively. Each of those elements of the adaptive light-intensity compensator 114 will now be described in detail.

The color coordinate estimator 134 estimates a color coordinate by using the voltage value V output from the integrator 124 of FIG. 3. The color coordinate estimated at the color coordinate estimator 134 means an RGB color coordinate of the liquid crystal panel 102 illustrated in FIG. 1. Since the intensity of white light emitted to the liquid crystal panel 102 varies with time and temperature, the color coordinate estimated at the color coordinate estimator 134 also varies with the time and temperature. The current color coordinate estimated at the color coordinate estimator 134 is provided to the comparator 136.

The comparator 136 compares the current color coordinate provided from the color-coordinate estimator 134 with a reference color coordinate to calculate a different value therebetween. The reference color coordinate refers to a reference RGB color coordinate of the liquid crystal panel 102. The current color coordinate provided from the color coordinate estimator 134 is affected by the time and temperature. Since an internal temperature of the liquid crystal panel 102 increases with operation time of the LCD device, the current color coordinate provided from the color coordinate estimator 134 varies with time and temperature.

The comparator 136 compares the current color coordinate from the color coordinate estimator 134 with a reference color coordinate in real time to calculate a difference value between the reference color coordinate and the current color coordinate. The difference value calculated at the comparator 136 allows detection of an error degree between the current color coordinate and the reference color coordinate, i.e., a degree to which the color coordinate is affected by time and temperature.

The difference value calculated at the comparator 136 is provided to the adder 137. An error degree of white light emitted to the liquid crystal panel 102 can be determined by using the difference value calculated at the comparator 136.

The adder 137 adds the difference value calculated at the comparator 136 to the reference color coordinate, and provides a resulting value to the first, second and third light-intensity compensators 144, 146 and 148. The white light currently emitted to the liquid crystal panel is compensated first with the value calculated at the adder 137. Accordingly, the color coordinate estimator 134, the comparator 136 and the adder 137 compare the current color coordinate of the white light emitted to the liquid crystal panel 102 with the reference color coordinate to detect a color coordinate.

The first light-intensity error detector 138 compares the intensity of the red light (R) estimated at the RGB light-intensity estimator 132 with a fist reference value to calculate a different value therebetween. The first reference value is a brightness value corresponding to an initial intensity of red light (R). The first light-intensity error detector 138 compares the intensity of the red light (R) estimated at the RGB light-intensity estimator 132 with the first reference value to calculate a first error value corresponding to a difference value therebetween. If the first error value increases, the current intensity of the red light (R) is smaller than the initial intensity of red light (R). The first error value calculated at the first light-intensity error detector 138 is provided to the first light-intensity compensator 144.

The second light-intensity error detector 140 compares the intensity of the green light (G) estimated at the RGB light-intensity estimator 132 with a second reference value to calculate a difference value therebetween. The second reference value is a brightness value corresponding to an initial intensity of green light (G). The second light-intensity error detector 140 compares the intensity of the green light (G) estimated at the RGB light-intensity estimator 132 with the second reference value to calculate a second error value corresponding to the difference value therebetween. If the second error value increases, the current intensity of the green light (G) is smaller than the initial intensity of the green light (G). The second error value calculated at the second light-intensity error detector 140 is provided to the second light-intensity compensator 146.

The third light-intensity error detector 142 compares the intensity of the blue light (B) estimated at the RGB light-intensity estimator 132 with a third reference value to calculate a difference value therebetween. The third reference value is a brightness value corresponding to an initial intensity of blue light (B). The third light-intensity error detector 142 compares the intensity of the blue light (B) estimated at the RGB light-intensity estimator 132 with the third reference value to calculate a third error value corresponding to the difference value therebetween. If the third error value increases, the current intensity of the blue light (B) is smaller than the initial intensity of the blue light (B). The third error value calculated at the third light-intensity error detector 142 is provided to the third light-intensity compensator 148.

The first light-intensity compensator 144 adds or subtracts the first error value calculated at the first light-intensity error detector 138 to or from the first-compensated value at the adder 137 to second compensate the intensity of the red light (R). The intensity of the red light (R) compensated at the first light-intensity compensator 144 is provided to the first pulse generator 150. The first pulse generator 150 generates a pulse corresponding to the compensated intensity of the red light (R) provided from the first light-intensity compensator 144, and provides the pulse to the first LED driver 116 of FIG. 1.

The second light-intensity compensator 146 adds or subtracts the second error value calculated at the second light-intensity error detector 140 to or from the first-compensated value at the adder 137 to second compensate the intensity of the green light (G). The intensity of the green light (G) compensated at the second light-intensity compensator 146 is provided to the second pulse generator 152. The second pulse generator 152 generates a pulse corresponding to the compensated intensity of the green light (G) provided from the second light-intensity compensator 146, and provides the pulse to the second LED driver 118 of FIG. 1.

The third light-intensity compensator 148 adds or subtracts the third error value calculated at the third light-intensity error detector 140 to or from the first-compensated value at the adder 137 to second compensate the intensity of the blue light (B). The intensity of the blue light (B) compensated at the third light-intensity compensator 148 is provided to the third pulse generator 154. The third pulse generator 154 generates a pulse corresponding to the compensated intensity of the blue light provided from the third light-intensity compensator 148, and provides the pulse to the third LED driver 120 of FIG. 1.

The first LED driver 116 generates an operating voltage so as to turn on the first LED array 105 of FIG. 2 of the backlight unit 110 in a High period of the pulse provided from the first pulse generator 150, and turn off the first LED array 105 in a Low period of the pulse. The second LED driver 118 generates an operating voltage so as to turn on the second LED array 107 of FIG. 3 of the backlight unit 110 in a High period of the pulse provided from the second pulse generator 152, and turn off the second LED array 107 in a Low period of the pulse. The third LED driver 120 generates an operating voltage so as to turn on the third LED array 109 of FIG. 3 of the backlight unit 110 in a High period of the pulse provided from the third pulse generator 154, and turn off the third LED array 109 in a Low period of the pulse.

The first, second and third LED arrays 105, 107 and 109 of FIG. 3 of the backlight unit 110 of FIG. 1 generate light having the compensated light intensities by the operating voltages generated from the first, second and third LED drives 116, 118 and 120 of FIG. 1, respectively. Then, the first, second and third LED arrays 105, 107 and 109 of FIG. 2 emit the light to the liquid crystal panel 102 of FIG. 1.

Accordingly, the LCD device according to an embodiment extracts a color coordinate of white light emitted to the liquid crystal panel to perform first compensation using a reference color coordinate. Also, the LCD device extracts red light, green light and blue light from the white light to detect respective light-intensity errors, and generates light having an intensity compensated as much as the detected errors.

Thus, the LCD device according to an embodiment can prevent an intensity of the white light emitted to the liquid crystal panel from decreasing over operation time or because of increasing internal temperature. Consequently, the intensity of the white light emitted to the liquid crystal panel does not decrease, and image quality improves.

Figure 5:
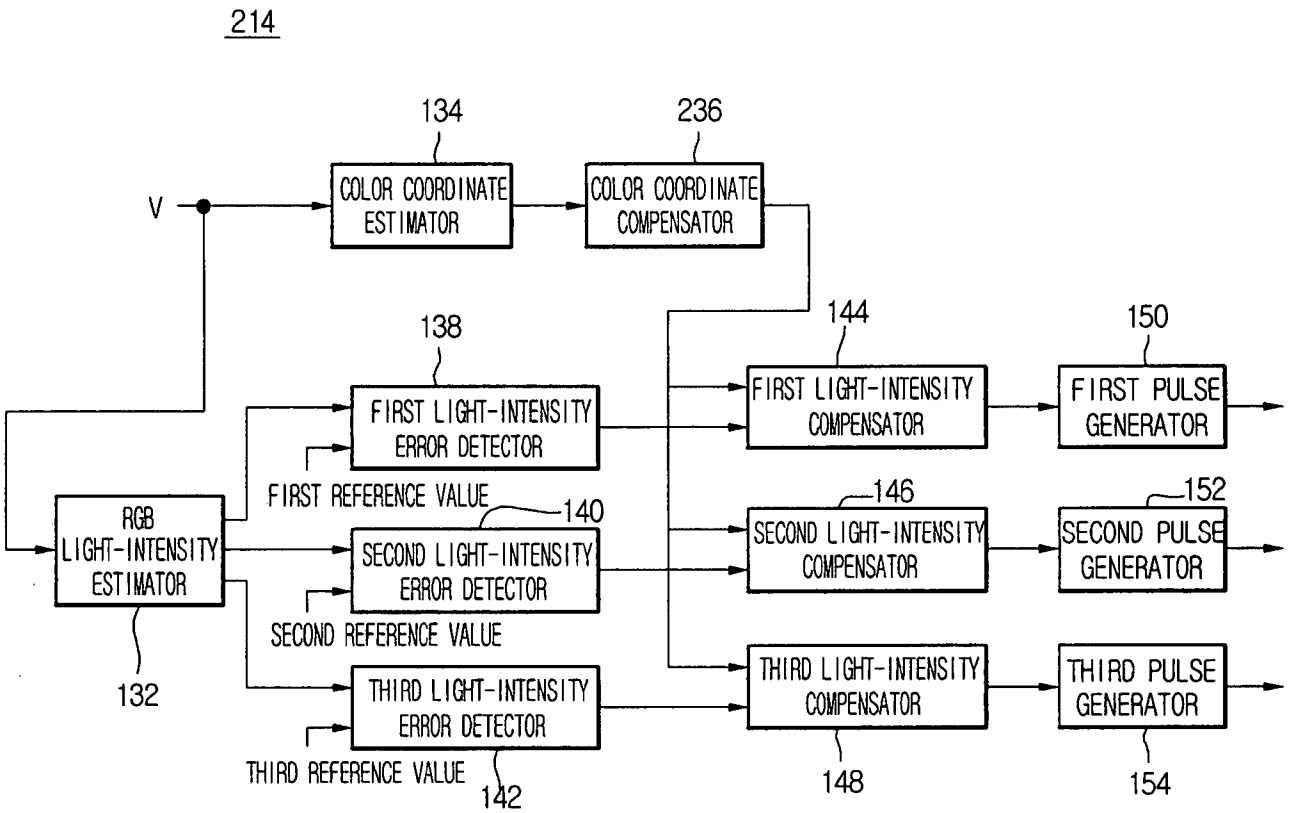
FIG. 5 is a block diagram of an adaptive light-quality compensator according to another embodiment.

FIG. 5 is a block diagram of an adaptive light-intensity compensator according to another embodiment. The adaptive light-intensity compensator 214 (FIG. 5) according to another embodiment includes a color coordinate estimator 134, a color coordinate compensator 236, an RGB light-intensity estimator 132, and first, second and third light-intensity error detectors 138, 140 and 142. The color coordinate estimator 134 estimates a current color coordinate of the liquid crystal panel 102 of FIG. 1 by using the voltage value V output from the integrator 124 of the LED light-intensity detector 112 illustrated in FIG. 3. The color coordinate compensator 236 compensates the current color coordinate estimated at the color coordinate estimator 134 by using a reference color coordinate (FIG. 4). The RGB light-intensity estimator 132 estimates intensities of red, green and blue light (R, G and B) by using the voltage value V output from the integrator 124. The first, second and third light-intensity error detectors 138, 140 and 142 compare the intensities of the red, blue and green light (R, G and B) estimated at the RGB light-intensity estimator 132 with first, second and third reference values to calculate difference values therebetween.

The adaptive light-intensity compensator 214 further includes first, second and third light-intensity compensators 144, 146 and 148, and first, second and third pulse generators 150, 152 and 154. The first, second and third light-intensity compensators 144, 146 and 148 respectively correspond to the first, second and third light-intensity error detectors 138, 140 and 142 to compensate the intensities of the red, green and blue light (R, G and B) by using the value compensated at the color coordinate compensator 236 and the different values provided from the first, second and third light-intensity error detectors 138, 140 and 142, respectively. The first, second and third pulse generators 150, 152 and 154 respectively correspond to the first, second and third light-intensity compensators 144, 146 and 148 to generate pulses corresponding to the light intensities compensated at the first, second and third light-intensity compensators 144, 146 and 148, respectively.

Among the elements of the adaptive light-intensity compensator 214, the color coordinate estimator 134, the first, second and third light-intensity error detectors 138, 140 and 142, the first, second and third light-intensity compensators 144, 146 and 148, and the first, second and third pulse generators 150, 152 and 154 are the same as those of the adaptive light-intensity compensator 114 illustrated in FIG. 4 according to an embodiment.

A description of the common elements in the adaptive light-intensity compensator 214 (FIG. 5) and adaptive light-intensity compensator 114 (FIG. 4).

The first light-intensity error detector 138 compares the intensity of the red light (R) estimated at the RGB light-intensity estimator 132 with the first reference value to detect a first error value corresponding to a difference value therebetween, and provides the first error value to the first light-intensity compensator 144. The second light-intensity error detector 140 compares the intensity of the green light (G) estimated at the RGB light-intensity estimator 132 with the second reference value to detect a second error value corresponding to a difference value therebetween, and provides the second error value to the second light-intensity compensator 146. The third light-intensity error detector 142 compares the intensity of the blue light (B) estimated at the RGB light-intensity estimator 132 with the third reference value to detect a third error value corresponding to a difference value therebetween, and provides the third error value to the third light-intensity compensator 148.

The color coordinate estimator 134 (FIGS. 4 and 5) estimates a current color coordinate of the liquid crystal panel 102 of FIG. 1 by using the voltage value V provided by the integrator 124, and provides the estimated current color coordinate to the color coordinate compensator 236 (FIG. 5).

Referring to FIG. 5, the color coordinate compensator 236 outputs a compensated color coordinate corresponding to the current color coordinate to the first, second and third light-intensity compensators 144, 146 and 148 by using the current color coordinate provided from the color coordinate estimator 134 as an address. The color coordinate compensator 236 may include a lookup table among memory devices storing compensated color coordinates corresponding to the current color coordinate by using the current color coordinate as an address.

The first light-intensity compensator 144 compensates the intensity of the red light (R) by using the compensated color coordinate provided from the color coordinate compensator 236 and the first error value provided from the first light-intensity error detector 138. The intensity of the red light (R) compensated at the first light-intensity compensator 144 is provided to the first pulse generator 150. The first pulse generator 150 generates a pulse corresponding to the light intensity provided from the first light-intensity compensator 144.

The second light-intensity compensator 146 compensates the intensity of the green light (G) by using the compensated color coordinate provided from the color coordinate compensator 236 and the second error value provided from the second light-intensity error detector 140. The intensity of the green light (G) compensated at the second light-intensity compensator 146 is provided to the second pulse generator 152. The second pulse generator 152 generates a pulse corresponding to the light intensity provided from the second light-intensity compensator 146.

The third light-intensity compensator 148 compensates the intensity of the blue light (B) by using the compensated color coordinate provided from the color coordinate compensator 236 and the third error value provided from the third light-intensity error detector 142. The intensity of the blue light (B) compensated at the third light-intensity compensator 148 is provided to the third pulse generator 154. The third pulse generator 154 generates a pulse corresponding to the light intensity provided from the third light-intensity compensator 148.

The pulses generated from the first, second and third pulse generators 150, 152 and 154 are provided to the first, second and third LED drivers 116, 118 and 120 of FIG. 1, respectively. The first, second and third LED drivers 116, 118 and 120 generate operating voltages corresponding to the pulses generated from the first, second and third pulse generators 150, 152 and 154, respectively.

The first, second and third LED arrays 105, 107 and 109 of FIG. 3 of the backlight unit 110 of FIG. 1 generate light having the compensated light intensity by the operating voltages generated from the first, second and third LED drivers 116, 118 and 120 of FIG. 1, respectively, and emit the light to the liquid crystal panel 102 of FIG. 1.

In the LCD device according to an embodiment, a color coordinate of a liquid crystal panel is extracted to perform first compensation using a reference color coordinate, and white light is split into red, green and blue light to detect light-intensity errors of each case. Then, light having an intensity compensated as much as the detected error is generated. Thus, the LED device according to an embodiment can prevent white light emitted to the liquid crystal panel from decreasing in intensity over operation time because of an increase in internal temperature. Since the intensity of the white light emitted to the liquid crystal panel does not decrease, the image quality can be improved.

In the LCD device according to an embodiment of the present invention, a color coordinate of the liquid crystal panel is estimated in real time, and the estimated color coordinate is compensated. The white light emitted to the liquid crystal panel is extracted into red light, green light and blue light. The intensity of the extracted light is detected to compare the detected intensity with a reference to detect an error value. An operation is performed on the detected error values and the compensated color coordinate to generate light with a compensated intensity.

In the LCD device according to an embodiment, light with an intensity compensated in real time is generated, so that the white light emitted to the liquid crystal panel is prevented from decreasing in intensity. Also, since the decrease in intensity of white light emitted to the liquid crystal panel is prevented, image quality can be improved.

It will be apparent to those skilled in the art that various modifications and variations is made in the recessed can lighting fixture of embodiments of the invention without departing from the spirit or scope of the invention. Thus, it is intended that embodiments of the invention cover the modifications and variations of this invention provided they come within the scope of the appended claims and their equivalents.

What is claimed is:

1. A liquid crystal display device, comprising:

a liquid crystal panel;

a backlight unit including first, second and third light emitting diode arrays respectively for generating red light, green light and blue light to provide white light to the liquid crystal panel;

first, second and third light emitting diode drivers for generating operating voltages driving the first, second and third light emitting diode arrays, respectively;

a light-intensity detector for detecting the intensity of the white light provided to the liquid crystal panel, the light-intensity detector comprising:

a photo sensor configured to:

detecting the intensity of the white light; and output an electrical signal corresponding to the detected intensity of the white light and an integrator configured to:

integrate the electrical signal output from the photo sensor; and output a voltage value of a direct current component based on the output of the photo sensor to the adaptive light-intensity compensator; and an adaptive light-intensity compensator for controlling the first, second and third light emitting diode drivers and compensating intensities of the red light, the green light and the blue light, respectively, wherein the adaptive light-intensity compensator includes:

red, green and blue light intensity estimators for estimating the respective intensities of the red light, the green light and the blue light from the intensity of the white light detected at the light-intensity detector, the respective light intensity estimators configured to estimate intensities of respective red, green and blue light based on a received voltage value output from the integrator, an error detection unit detecting error values of the intensities of the red light, the green light, and the blue light estimated by the red, green and blue light intensity estimators, respectively, the error being detected by comparing the intensity of respective red, green and blue light estimated by the light intensity estimators with respective reference values to calculate respective difference values therebetween, a color coordinate detector for detecting a color coordinate by using the respective intensities of the red light, the green light and the blue light estimated by the red, green and blue light intensity estimators, respectively, the color coordinate detector comprising:

a color coordinate estimator configured to:

receive the voltage value from the integrator, and estimate a color coordinate by using the voltage value from the integrator and the intensities of the red light, the green light and the blue light estimated by the red, green and blue light intensity estimators, respectively, and a color coordinate compensator configured to output a compensated color coordinate corresponding to the estimated color coordinate by using the color coordinate estimated at the color coordinate estimator as an address, and a light-intensity compensation unit configured to perform an operation on the color coordinate and the error values detected at the error detection unit to compensate the intensities of the red light, the green light and the blue light, respectively.

2. The device according to claim 1, wherein the color coordinate compensator comprises a lookup table.

3. The device according to claim 1, wherein the color coordinate detector comprises:

a comparator for comparing the color coordinate estimated at the color coordinate estimator with a reference color coordinate to calculate a difference value therebetween; and an adder performing an operation on the difference value calculated at the comparator and the reference color coordinate to calculate a compensated color coordinate.

4. The device according to claim 1, wherein the adaptive light-intensity compensator further comprises a pulse generation unit for generating pulses corresponding to the intensities compensated at the light-intensity compensation unit.

5. The device according to claim 1, further comprising an amplifier placed between the photo sensor and the integrator and amplifying the electrical signal output from the photo sensor.

6. The device according to claim 1, wherein the photo sensor comprises one of a photo diode and a photo transistor.

7. A method of driving a liquid crystal display device including a liquid crystal panel and first, second and third light emitting diode arrays respectively generating red light, green light and blue light to provide white light to the liquid crystal panel, the method comprising:

detecting an intensity of the white light provided to the liquid crystal panel by:

detecting, by a photo sensor, the intensity of the white light outputting, by the photo sensor, an electrical signal corresponding to the detected intensity of the white light;

integrating, by an integrator, the electrical signal output from the photo sensor; and outputting, by the integrator, a voltage value of a direct current component based on the output of the photo sensor to the adaptive light-intensity compensator;

estimating, by respective light intensity estimators, respective intensities of red light, green light and blue light by using the detected intensity of the white light, the respective light intensities of respective red, green and blue light being based on a received voltage value output from the integrator;

compensating intensities of the red light, the green light and the blue light on the basis of the estimated intensities of the red light, the green light and the blue light, respectively; and generating operating voltages to allow the first, second and third light emitting diode arrays to generate light with the compensated light intensity, respectively wherein the compensating of the intensities includes:

detecting error values of the intensities of the red light, the green light, and the blue light, respectively, the error being detected by comparing the intensity of respective red, green and blue light estimated by the light intensity estimators with respective reference values to calculate respective difference values therebetween, estimating a color coordinate, by a color coordinate estimator, using the intensity of the white light, and performing an operation on the estimated color coordinate and the detected error values to compensate the intensities of the red light, the green light, and the blue light, respectively, wherein:

the color coordinate estimator receives the voltage value from the integrator and uses the voltage value from the integrator and the respective estimated intensities of the red light, the green light and the blue light, and outputting a compensated color coordinate corresponding to the estimated color coordinate by using the estimated color coordinate as an address, and compensating for light intensity by performing an operation on the color coordinate and the error values detected at the error detection unit to compensate the intensities of the red light, the green light and the blue light, respectively.

8. The method according to claim 7, wherein the detecting of the intensity comprises:

detecting the intensity of the white light provided to the liquid crystal panel and providing as output an electrical signal corresponding to the detected intensity of the white light; and integrating the output electrical signal to output a voltage value of a direct current component.

9. The device according to claim 1, wherein the integrator comprises a low-pass filter.

10. The method according to claim 7, wherein the integrator comprises a low-pass filter.

* * * * *